US005585331A

United States Patent [19]

Mansour et al.

[11] Patent Number: 5,585,331

[45] Date of Patent: *Dec. 17, 1996

[54] MINIATURIZED SUPERCONDUCTING DIELECTRIC RESONATOR FILTERS AND METHOD OF OPERATION THEREOF

[75] Inventors: Raafat R. Mansour, Waterloo; Van Dokas, Cambridge, both of Canada

[73] Assignee: Com Dev Ltd., Cambridge, Canada

[ * ] Notice: The term of this patent shall not extend beyond the expiration date of Pat. No. 5,498,771.

[21] Appl. No.: 348,859

[22] Filed: Nov. 28, 1994

Related U.S. Application Data

[63] Continuation-in-part of Ser. No. 161,256, Dec. 3, 1993, Pat. No. 5,498,771.

[51] Int. Cl.[6] ..... H01P 1/201; H01P 7/10

[52] U.S. Cl. ..... 505/210; 505/700; 505/866; 333/202; 333/219.1; 333/99 S

[58] Field of Search ..... 333/202, 219.1, 333/99 S; 505/210, 700, 701, 866

[56] References Cited

U.S. PATENT DOCUMENTS 4,521,746 6/1985 Hwan et al. ..... 333/219.1 X 5,179,074 1/1993 Fiedziuszko et al. ..... 333/219.1 X

*Primary Examiner*—Benny T. Lee

*Attorney, Agent, or Firm*—Daryl W. Schnurr

[57] ABSTRACT

Microwave bandpass filters contain dielectric resonators mounted in dielectric blocks, which are in turn mounted in cavities. There can be more than one dielectric resonator per cavity. Significant size reduction has been achieved over prior art filters. The filters can be operated at cryogenic temperatures and since the results attainable at cryogenic temperatures are repeatable, the filters can be tuned at cryogenic temperatures and returned to room temperature before being returned to cryogenic temperatures for operating purposes. When operated at cryogenic temperatures, the filters contain shorting plates having high temperature superconducting material thereon. The filters can be constructed with various configurations and can be operated in either a single mode or a dual-mode. Previous single mode or dual-mode dielectric resonator filters are larger in size and mass than the filters of the present application.

39 Claims, 15 Drawing Sheets

MINIATURIZED SUPERCONDUCTING DIELECTRIC RESONATOR FILTERS AND METHOD OF OPERATION THEREOF

CROSS-REFERENCE TO RELATED APPLICATION

This is a continuation-in-part application of application Ser. No. 08/161,256 entitled "Miniaturized Dielectric Resonator Filters and Method of Operation Thereof at Cryogenic Temperatures", filed Dec. 3, 1993. application Ser. No. 08/161,256 is incorporated by reference herein. Application Ser. No. 08/161,256 referred to herein issued to a patent on Mar. 12th, 1996 and was assigned U.S. Pat. No. 5,498,771.

BACKGROUND OF THE INVENTION

1. Field of the Invention

This invention relates to microwave bandpass filters, and more particularly, to a filter design which allows further substantial miniaturization, and to an improved method of tuning and operation at cryogenic temperatures.

2. Description of the Prior Art

The use of dielectric resonators in microwave filters results in a significant reduction in size and mass while maintaining a performance comparable to that of waveguide filters without dielectric resonators.

A typical dielectric resonator filter consists of a ceramic resonator disc mounted in a particular way inside a metal cavity. In addition to miniaturization, loss performance, as well as thermal and mechanical stability are also important design objectives for dielectric resonator filters. A number of specific refinements can be incorporated in furtherance of these goals.

For instance, in dielectric resonator filters the size of the cavity can be substantially reduced by mounting the dielectric resonator along a base wall of the cavity rather than mounting the resonator in a center of the cavity. This eliminates the need for a centering stem-type mounting, and it allows a reduction in the size of the microwave cavity. See, U.S. Pat. No. 4,423,397 issued to Nishikawa, et al. However, it is difficult to attach the dielectric resonator to the base wall in such a way that proper electrical contact is ensured. Conductive glues and the like can result in a change in frequency of the filter, thereby reducing the Q (i.e. quality factor). Moreover, this type of mounting is prone to the thermal expansion caused by wide temperature variations, and to the mechanical vibrations that must be endured when the filter is used in space applications.

Multiple mode filters also can provide further miniaturization over single mode filters. For instance, single, dual and triple mode dielectric resonator waveguide filters are known (See U.S. Pat. No. 4,142,164 by Nishikawa, et al., issued Feb. 27th, 1979; U.S. Pat. No. 4,028,652 by Wakino, et al. issued Jun. 7th, 1977; Paper by Guillon, et al. entitled "Dielectric Resonator Dual-Mode Filters", Electronics Letters, Vol. 16, pages 646 to 647, Aug. 14th, 1980; U.S. Pat. No. 4,675,630 by Tang, et al. issued Jun. 23rd, 1987; U.S. Pat. No. 4,652,843 by Tang, et al. issued Mar. 24th, 1987; and U.S. Pat. No. 5,083,102 by Zaki.).

The use of superconductors is a more recent advance which holds good potential. For example, a hybrid dielectric resonator high temperature superconductor filter is known which utilizes a plurality of resonators in a cavity where each resonator is spaced from a conductive wall of the cavity by a superconductive layer. The superconductive layer is capable of superconducting at temperatures as high as about 77° K. Existing super-conductive filters cannot produce repeatable results when these filters are tuned at cryogenic temperatures, then allowed to return to room temperature and subsequently return to cryogenic temperatures. As a result, a heat exchanger is necessary to maintain the filter housings at or below the critical temperature of the superconductor after the filters have been tuned. Any further miniaturization gained by the use of superconductors is undermined by the need to employ a bulky heat exchanger or like refrigerant.

Finally, U.S. Pat. No. 4,881,051 by W. C. Tang, et al. issued Nov. 14th, 1989 describes a dielectric image-resonator multiplexer. The use of image resonators, as disclosed in the Tang '051 patent, allows smaller sectional resonator elements with some degradation in loss performance.

It would be greatly advantageous to improve the miniaturization and loss performance of a dielectric resonator filter by incorporating superconductive materials and image resonators in a simplified design, and to improve the thermal and mechanical stability of the filter by using mounting blocks.

SUMMARY OF THE INVENTION

It is an object of the present invention to provide a dielectric resonator filter that can be used in conventional and cryogenic applications.

It is a further object of this invention to provide a dielectric resonator filter that is compact in size with a remarkable loss performance compared to previous filters.

It is still a further object of the present invention to provide a dielectric resonator filter in which thermal stability problems associated with operation of previous filters at cryogenic temperatures have been reduced or eliminated. The filter is capable of producing repeatable performance results as temperature changes from cryogenic to room temperature and then back to cryogenic without readjusting the tuning screws.

In accordance with the above and other objects, the invention provides a microwave filter having at least one microwave cavity, an input and an output, and a dielectric block disposed in the cavity. The dielectric block supports at least one dielectric resonator inside the cavity. The quality factor ("Q") of the support block improves as the ambient temperature changes from 300° K to 77° K. Consequently, the use of the dielectric block to support the resonator element in cryogenic applications considerably reduces the size of the filter without detracting from performance.

The dielectric block is sized and shaped relative to the cavity so that the block fits securely within the cavity. The block has an interior that is sized and shaped to hold the dielectric resonator. The support block also remains in contact with a shorting plate that is located within the filter, and the support block preferably holds the shorting plate in a fixed position. As previously described, the role of the shorting plate is to reduce size and improve spurious-free performance. The maximum attainable spurious-free window for C-band dielectric resonator filters is typically 500 MHz to 800 MHz. In contrast, the filter of the present invention has an upper spurious-free window of more than 1.2 GHz.

In operation, the microwave cavity resonates in at least one mode at its resonant frequency, there being one tuning screw for each mode and for each resonator within the cavity. There is one coupling screw for every two modes that are coupled within the cavity. The cavity housing has suitable openings to accommodate the tuning screw(s) and coupling screw(s). One of the major shortcomings of existing filters with tuning screws has been their thermal instability across wide temperature ranges. The present invention is stable to ensure performance repeatability as the temperature changes from cryogenic (during tuning and testing) to room temperature (during storage) and then back to cryogenic temperature.

The invention also provides a method of using the microwave filter as described above, the method including the steps of tuning the filter while at cryogenic temperatures, raising the temperature of the filter to ambient temperature for storage or transport, and deploying and operating the filter at cryogenic temperatures. Despite the wide temperature variations and thermal expansion/contraction, the filter can produce repeatable results without adjusting the tuning screws after the filter is first tuned at cryogenic temperatures.

Other advantages and results of the invention are apparent from the following detailed description by way of example of the invention and from the accompanying drawings.

DESCRIPTION OF A PREFERRED EMBODIMENT

Figure 1:
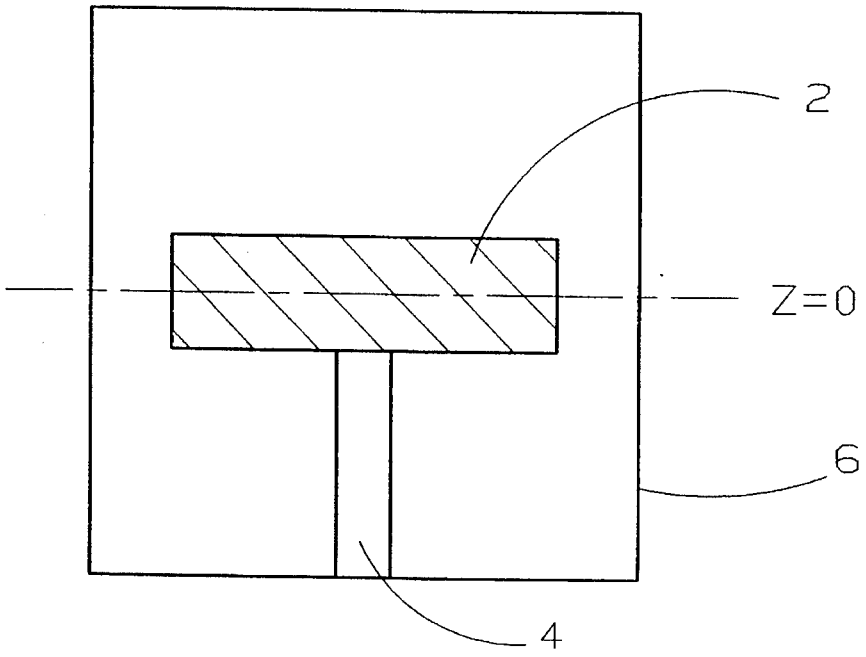
FIGURE 1 (PRIOR ART)
FIG. 1 is a schematic side view of a prior art dielectric resonator cavity with a resonator element mounted centrally in the cavity.

FIG. 1 shows a dielectric resonator 2 located on a support 4 in a cavity 6. The resonator 2 is supported in a plane z=0 in which the tangential field of the HEE, TEE or TME modes vanishes.

Figure 2:
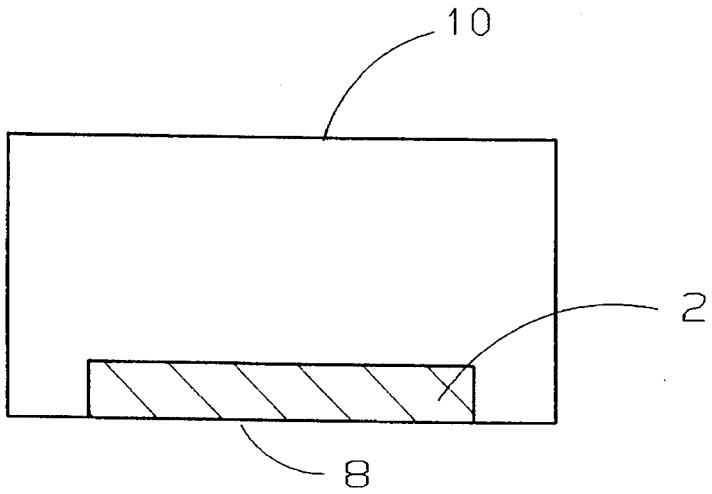
FIGURE 2 (PRIOR ART)
FIG. 2 is a schematic side view of a prior art dielectric resonator cavity with a resonator element mounted flush on a bottom surface of said cavity.

In FIG. 2, the same reference numerals as those of FIG. 1 are used to describe the same components. However, here the dielectric resonator 2 is mounted on a base 8 of a cavity 10. The base 8 is a conducting wall, and if perfectly conductive it would not change the resonant frequencies of the modes. Hence, the conducting base 8 can be used to reduce the size of the cavity 10 by eliminating the support 4 of FIG. 1. Unfortunately, it is difficult to attach the dielectric resonator 2 to the conducting base 8 as glues and the like may damp the oscillations, thereby reducing the quality factor Q of the resonator 4. It has also been found that the electrical contact between the dielectric resonator 2 and conducting base 8 is adversely affected by thermal expansion, especially since glues and the like are prone to cracking at cryogenic temperatures. Furthermore, if the conducting plane or base 8 is formed of conventional materials there will inherently be a small resistance. Any amount of resistance will likewise degrade the quality factor Q. It is therefore important to devise a support for the resonator which maximizes the resonator loaded Q while withstanding mechanical vibrations and also meeting all filter thermal requirements.

For use of a filter at cryogenic temperatures, the loaded Q of the resonator will be improved by replacing the conducting plate 8 shown in FIG. 2 by ceramic materials that become superconducting at liquid nitrogen temperatures. The loss tangent of dielectric resonator materials decreases as the temperature decreases. Therefore, by combining high temperature superconducting materials with dielectric resonators, it is possible to achieve a dielectric resonator filter with superior loss performance for cryogenic applications.

Typically, microwave cavity filters have tuning screws that must be tuned at temperatures approximating those in which the filter will ultimately be deployed. Consequently, superconductive filters intended for space applications must be tuned at cryogenic temperatures. However, after they have been tuned the filters must be stored prior to deployment. It would be most convenient to store the filters at room temperature, but the large temperature swing back to room temperature would cause significant thermal expansion. With the prior art superconducting filters, the thermal expansion of component parts is non-uniform, and these filters lose their initial tuning as they warm to ambient temperatures. For this reason, heat exchangers or other temperature control means must be used to maintain the prior art filters at cryogenic temperatures after the filters have been tuned.

The unique filter structure of the present invention promotes uniform thermal expansion, thereby eliminating the need for temperature control. The filter structure of the present invention keeps the performance repeatable as the temperature changes from cryogenic to room temperature and then back to cryogenic.

Figure 3:
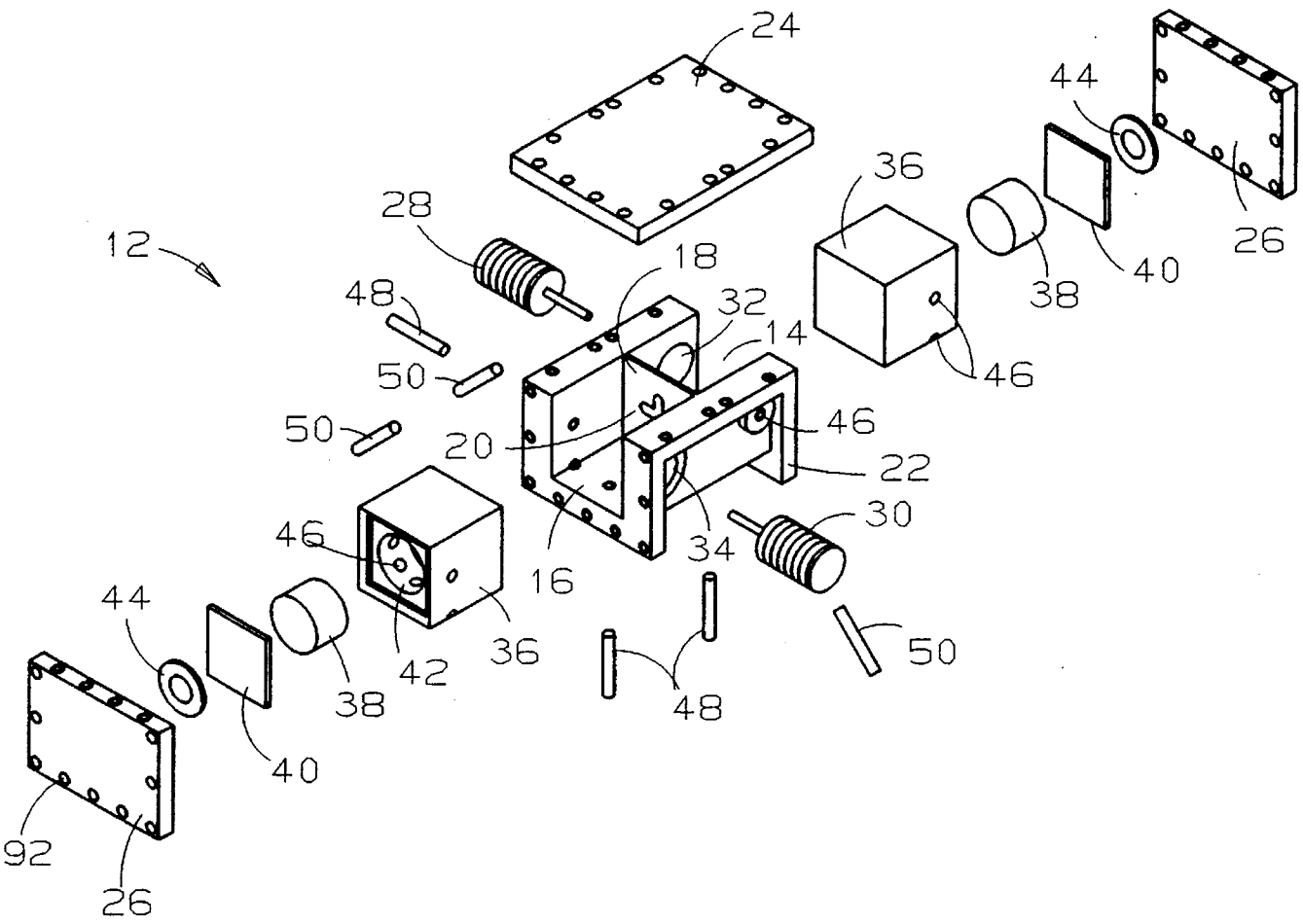
FIG. 3 is an exploded perspective view of a dielectric resonator filter in accordance with the present invention, said filter having two cavities with one dielectric resonator in each cavity, the two cavities being separated by an iris.

An embodiment of the present invention is shown in FIG. 3. Here, a dielectric resonator filter 12 has two cavities 14, 16 that are separated by an iris 18 containing an aperture 20. The iris 18 could be in the form of a rectangular slot, a cross-slot or various other known shapes. The illustrated aperture is shown only partially but is a cruciform aperture. The filter 12 has a housing 22 that includes a cover 24 and two end plates 26. The housing 22 can be made of any known metallic materials that are suitable for waveguide housings, for example, Invar. Screws to secure the cover 24 and end plates 26 onto the housing 22 are not shown. The filter has an input 28 and output 30, both of which are shown to be exemplary microwave probes that are mounted in holes 32, 34 respectively of the housing 22.

Each cavity 14, 16 contains a dielectric block 36, which in turn contains a dielectric resonator 38 and a shorting plate 40 connected thereto. The block 36 is sized and shaped to fit within the cavity in which it is located. The block 36 of the present embodiment is solid except for a recess 42 that corresponds to a size and shape of each resonator 38 and shorting plate 40. Preferably, each block 36 fits within the cavity in which it is located and the resonator 38 and shorting plate 40 in turn are held snugly within the block 36 in a fixed position. The dielectric block 36 may be commercially available TRANS-TECH D-450 series material with a coefficient of thermal expansion (CTE) of 2.4 ppm/°C. However, other materials are also suitable, such as sapphire with a CTE of 8.4 ppm/°C., or quartz single crystal with a CTE of 7.10 ppm/°C. parallel to the Z-axis and 13.24 ppm/°C. perpendicular to the Z-axis.

To keep performance repeatable as outside temperatures change from cryogenic to room temperature and then back to cryogenic, the CTE of the dielectric blocks 36 should substantially match that of the housing 22. This way, these components will expand and contract at substantially the same rate, and this will ensure performance repeatability as the ambient temperature changes from cryogenic to room temperatures (i.e. during shipping and storage) and then back to cryogenic temperatures (during testing and operation). The dielectric resonators may be made of commercially available Murata M series material with a CTE of 7.0 ppm/°C. In some filters, the dielectric blocks 36, the housing 22 and the dielectric resonators 38 will be made of different materials having substantially the same CTE. While it is preferred to have the same CTE between the resonators and the blocks, filters manufactured in accordance with the present invention can have dielectric resonators with a substantially different CTE from the dielectric blocks.

The matched CTEs ensure thermal stability across a wide temperature range. During testing, a filter as described in FIG. 3 was tuned initially at cryogenic temperature. The filter was then recycled a number of times between cryogenic temperature and room temperature. No performance degradation was observed as the filter was retested at cryogenic temperatures. After the intial tuning (such as during shipping and storage), there is no longer any need to use a heat exchanger or refrigerant to maintain the filter at cryogenic temperatures. The filter of the present invention remains stable despite ambient temperature fluctuations.

The shorting plates 40 are preferably coated with a high-conductivity non-oxidizing metal such as gold or a high-temperature superconducting material. The role of the shorting plate 40 is to shift down the resonant frequency of the dielectric resonator element, thereby allowing the use of the smaller resonator. In addition, the flush mounting of the resonator element eliminates the need for the spacer/support 4 of FIG. 1, and this too helps to reduce the filter size. Spring washers (e.g., belleville washers) 44 are used to support and hold the dielectric resonators 38 and shorting plates 40 in place inside the support block 36. The spring washers 44 are inserted between the end plates 26 and the shorting plates 40 to urge the shorting plate 40 into good contact with the resonator 38. This way, the spring washers 44 help to provide a firm and constant pressure between the dielectric resonators 38 and the shorting plates 40. The constant pressure insures good electrical contact despite the large amounts of thermal expansion and contraction which may take place. The spring washers 44 may be any type of metal or other material. However, to improve loss performance the spring washers 44 should be plated with a high-conductivity material such as silver, gold or copper. Silver-plated stainless steel spring washers 44 achieve good results.

The housing 22 as well as the block 36 contains suitable openings 46 to receive tuning and coupling screws 48, 50. Tiny holes 92 around the periphery of the end plates 26 are sized to receive screws (not shown) so that the various components can be held together.

In operation, the filter 12 can be operated in a dual HE mode to realize a four-pole dual-mode response or a TE mode to realize a two-pole single mode filter or a TM mode to realize a two-pole single mode filter. The filter 12 shown in FIG. 3 operates in a dual-mode. Energy is coupled into the cavity 14 through input probe 28. Energy is coupled between the two modes within the cavity 14 by coupling screw 50 and is coupled through the aperture 20 into the cavity 16. Energy within the cavity. 16 is coupled between the two modes by coupling screw 50 and exits the cavity 16 through the output 30. It can be seen that the blocks 36 are sized and shaped to substantially fill each of the cavities 14, 16.

Figure 4:
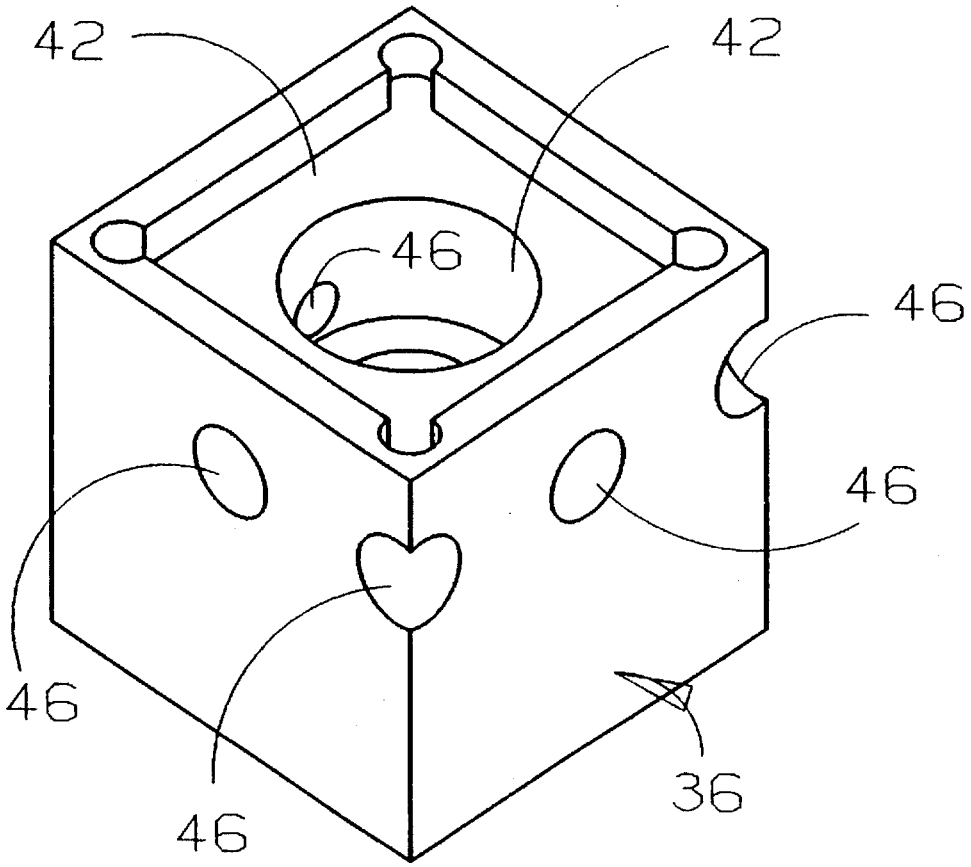
FIG. 4 is a partially cut-away perspective view of a dielectric block used in the filter shown in FIG. 3.

In FIG. 4, there is an enlarged perspective view of a block 36 of FIG. 3. In this embodiment the hollow portion 42 has a cylindrically-shaped section that is sized to receive the resonator 38 (not shown in FIG. 4) and a square section adjacent thereto that is sized and shaped to receive the shorting plate 40 (not shown in FIG. 4). It can also be seen that when inserted, the resonator 38 (not shown in FIG. 4) and shorting plate 40 (not shown in FIG. 4) will fit snugly within the hollowed portion 42. Elements referred to in FIG. 4 are described using the same reference numerals as those used in FIG. 3.

Figure 5:
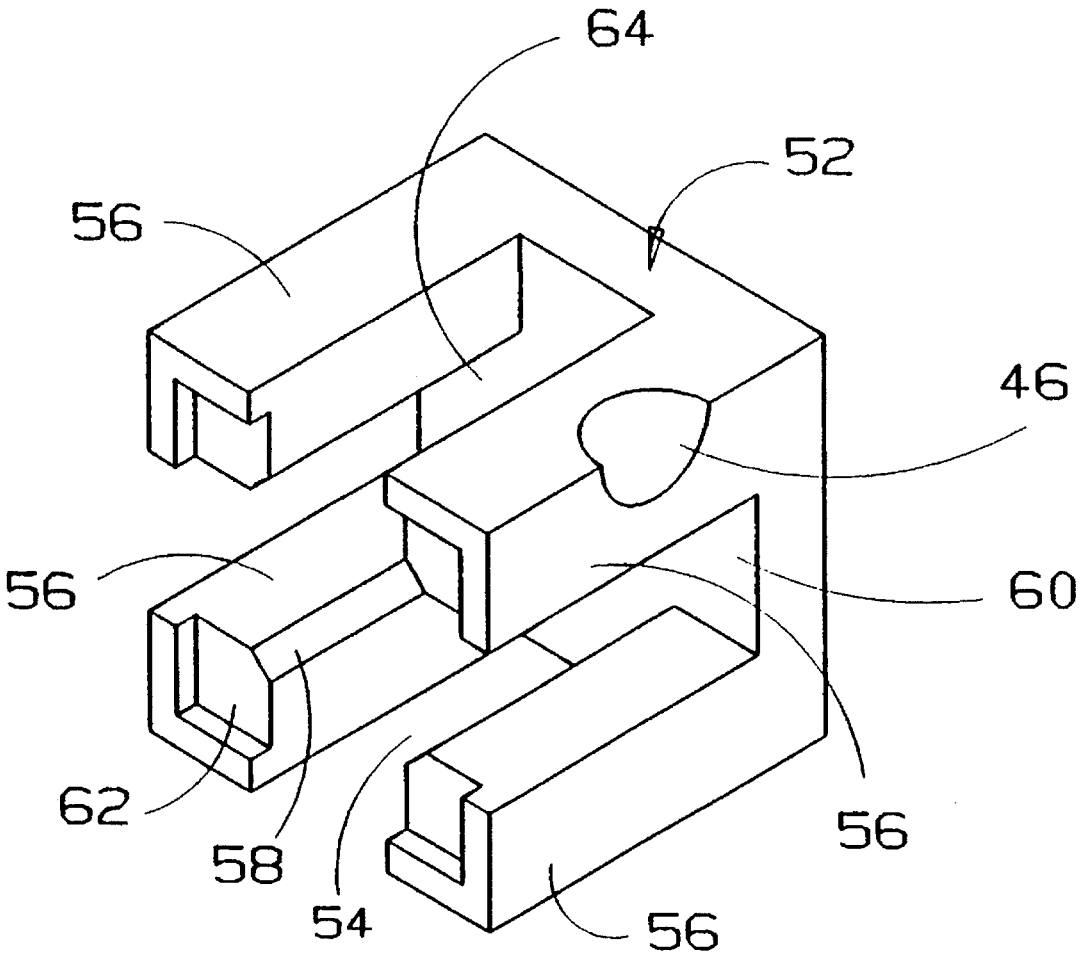
FIG. 5 is a perspective view of an alternate embodiment of the block of FIG. 4.

In FIG. 5, there is shown a perspective view of another block 52, which can be used as an alternative to the block 36 of FIG. 4. The block 52 has an interior 54 that is sized and shaped to receive a cylindrical resonator 38 (not shown in FIG. 5) and a shorting plate 40 (not shown in FIG. 5).

The block 52 has four legs 56 that are identical to one another. Each leg 56 has an arc-shaped interior surface 58. The resonator 36 rests against these arc-shaped surfaces 58 and against a base 60 so that the resonator is snugly supported within the block 52. The shorting plate is supported on shoulders 62 of each of the legs 56. The shorting plate is also supported snugly on the shoulders. The block 56 has openings 46, 64 to receive tuning and coupling screws 48, 50 (not shown in FIG. 5). The openings 46 could be blind or through. The outside dimensions of the block 52 are chosen so that the block fits snugly within the cavity. The five inside dimensions (i.e. the distance between each of the four legs 56 and the length of the four legs relative to the base 60) are chosen so that the resonator and shorting plate fit snugly within the block. In comparison with the block 36, with the block 52 material has been removed to reduce the mass and to improve the loss performance.

Figure 6:
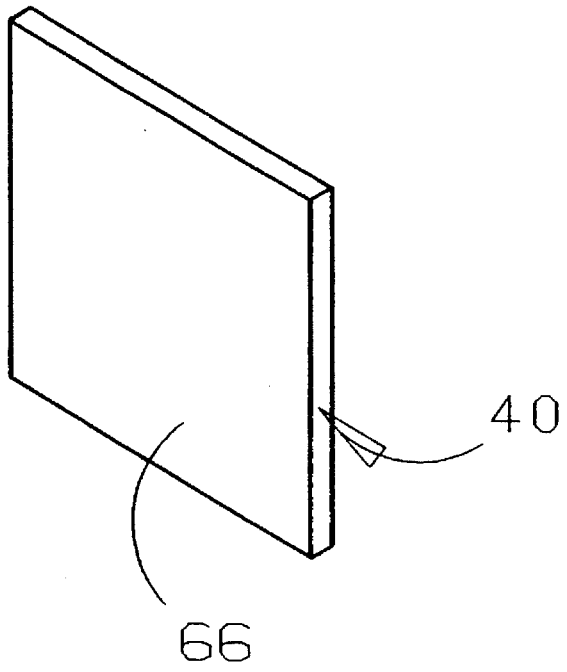
FIG. 6 is a perspective view of a shorting plate made of Invar (a trade mark) with one surface thereof plated with a suitable metal.

In FIG. 6, there is shown a shorting plate 40 having a surface 66 that contacts the resonator 38 (not shown in FIG. 6) when the shorting plate and resonator are installed within a block (not shown). The contact surface 66 is plated with silver or gold in order to reduce the RF losses.

Figure 7:
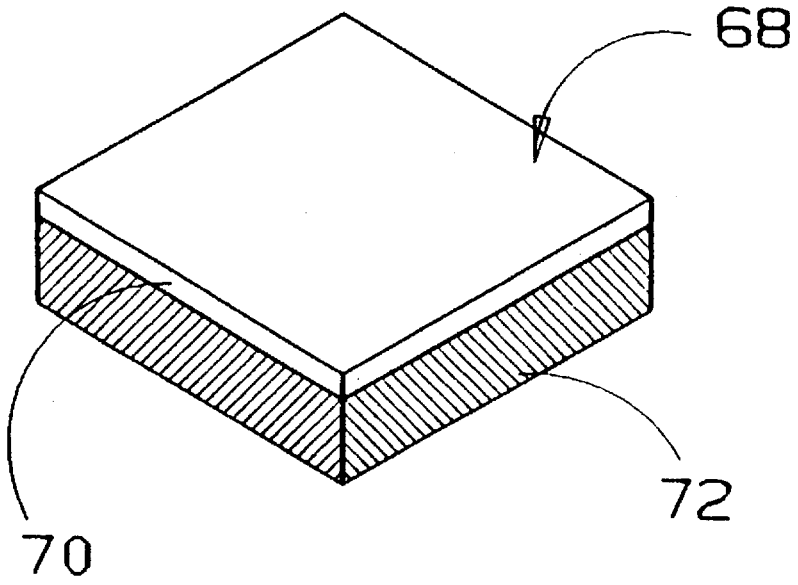
FIG. 7 is a perspective view of a shorting plate made of a dielectric substrate with one surface thereof coated with a suitable metal or high temperature ceramic material.

In FIG. 7, in a further embodiment a shorting plate 68 has a contact surface 70, which is a thin film layer made out of gold or silver deposited on a dielectric substrate 72. The shorting plates 40, 68 shown in FIGS. 6 and 7 can be used in the filter 12 for cryogenic or conventional room temperature applications. For cryogenic applications, the thin film layer for the contact surface of the shorting plate can be made out of high temperature ceramic materials that become superconductors at cryogenic temperatures (e.g. 77° K. or lower) such as yttrium barium copper oxide (YBCO) or thallium barium copper calcium oxide (TBCCO). The dielectric substrate 72 can be made out of lanthium aluminate or sapphire or any other suitable dielectric substrate material.

As previously mentioned, the role of the shorting plate 40 is to shift down the resonant frequency of the dielectric resonator as this reduces the filter size. The shorting plates 40 act as image plates, and this is similar in concept to the dielectric image-resonator multiplexer set forth in U.S. Pat. No. 4,881,051 issued to W. C. Tang, et al. on Nov. 14th, 1989.

However, a true image plate would cover an entire wall of the microwave cavity (for example, as in FIG. 2 of the present application), and this in turn allows the resonator 2 to be cut in half. The shorting plates 40 of the present invention cover a significant portion of one wall of the microwave cavity. They can therefore be considered image plates, although not full image plates as described above. Nevertheless, image resonance can be incorporated to varying degrees, and this is true of single and dual-mode filter embodiments.

The use of high temperature superconductor materials, instead of gold or silver, significantly improves the loss performance of the dielectric resonator filter for cryogenic applications. It is not necessary that the shorting plate have a square shape. The shorting plate could be rectangular, circular or any other shape or any size so long as it is large enough to cover the circular cross-sectional shape of the dielectric resonators. The dielectric blocks could also be any suitable shape as long as they are sized and shaped to fit snugly within the cavity and have an interior that is sized and shaped to securely support the dielectric resonator and shorting plate. For example, the blocks could have a cylindrical shape and still be used in a square or rectangular-shaped cavity so long as they are sized to fit snugly within the cavity. Further, if the cavity had a cylindrical shape, the blocks could have a square rectangular shape or a cylindrical shape so long as they had a size and shape to fit snugly within the cavity.

Figure 8:
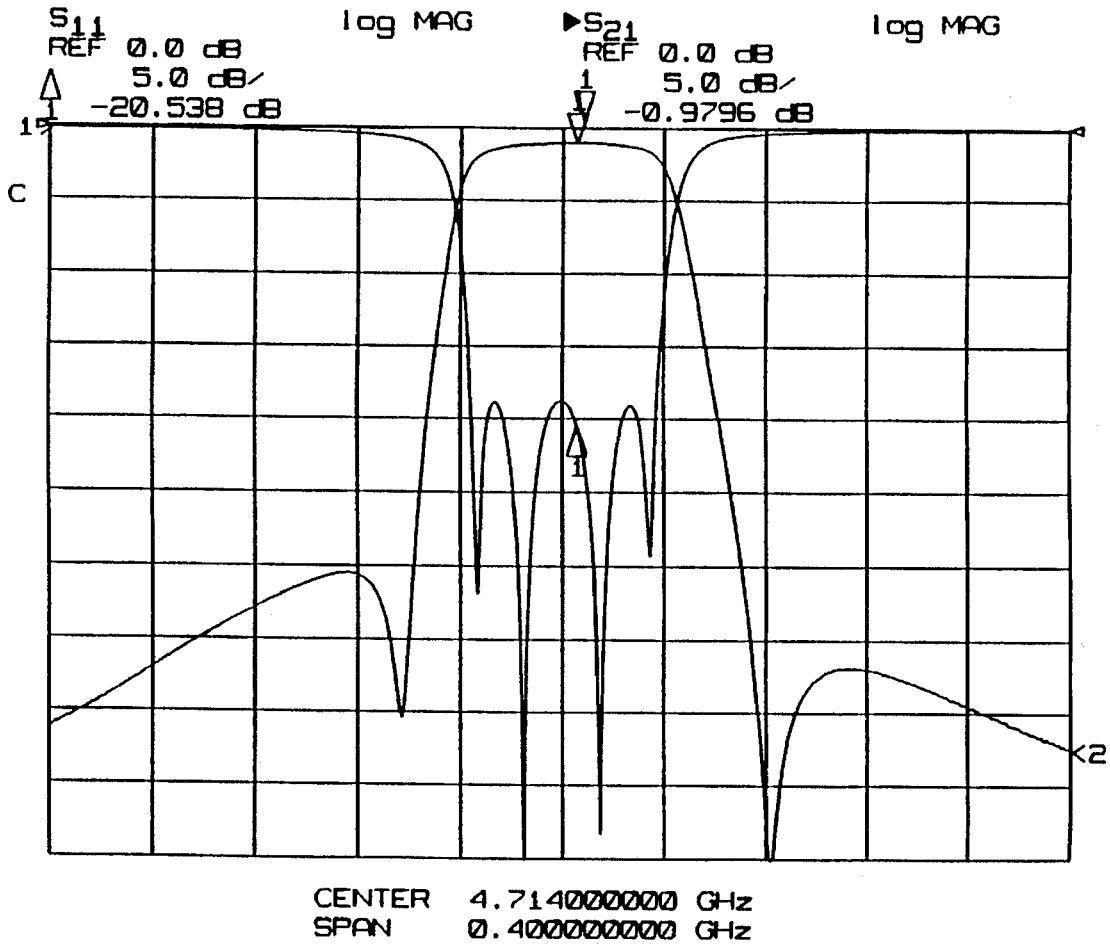
FIG. 8 is a graph illustrating the RF performance of a dielectric resonator filter as described in FIG. 3 where blocks of said filter are made out of sapphire.
Figure 9:
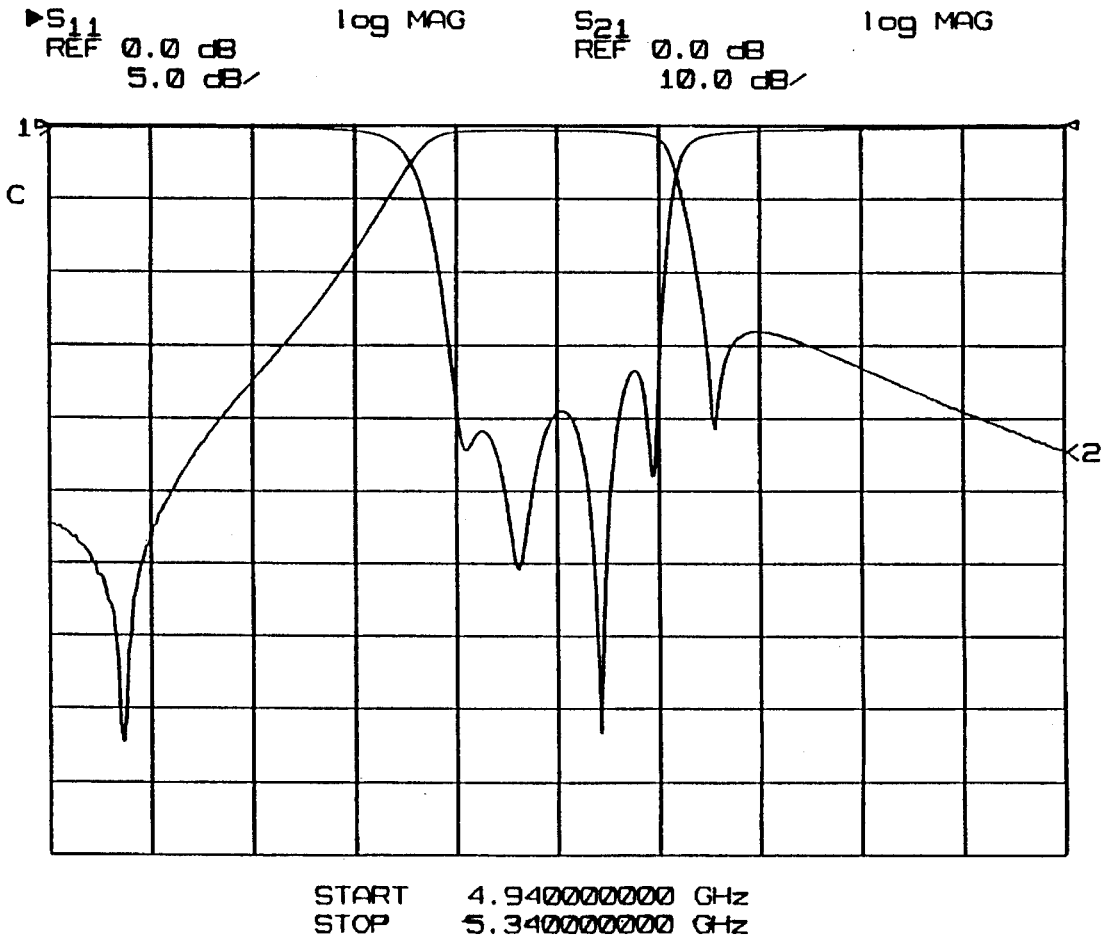
FIG. 9 is a graph illustrating the RF performance of the dielectric resonator filter of FIG.3 where the blocks of the filter are made of "D4"(a trademark of TRANS-TEC)

FIGS. 8 and 9 illustrate the insertion loss and return loss of a four-pole filter as described in FIG. 3 measured at room temperatures. The results in FIG. 8 were achieved with the blocks 36 made out of sapphire while those in FIG. 9 were achieved with the blocks 36 made out of D4(a trade mark). The shorting plates 40 used for both FIG. 8 and FIG. 9 were made out of silver plated Invar. Although conventional dielectric resonators can be designed to provide a similar RF performance, they will be considerably larger in size and mass. The size and mass reduction of filters constructed in accordance with the present invention can be more than 50% compared to conventional dielectric resonator filters. When compared to the planar dual-mode filter design described in U.S. Pat. No. 4,652,843, size savings of 80% and mass savings of 50% have been achieved.

Figure 10A:
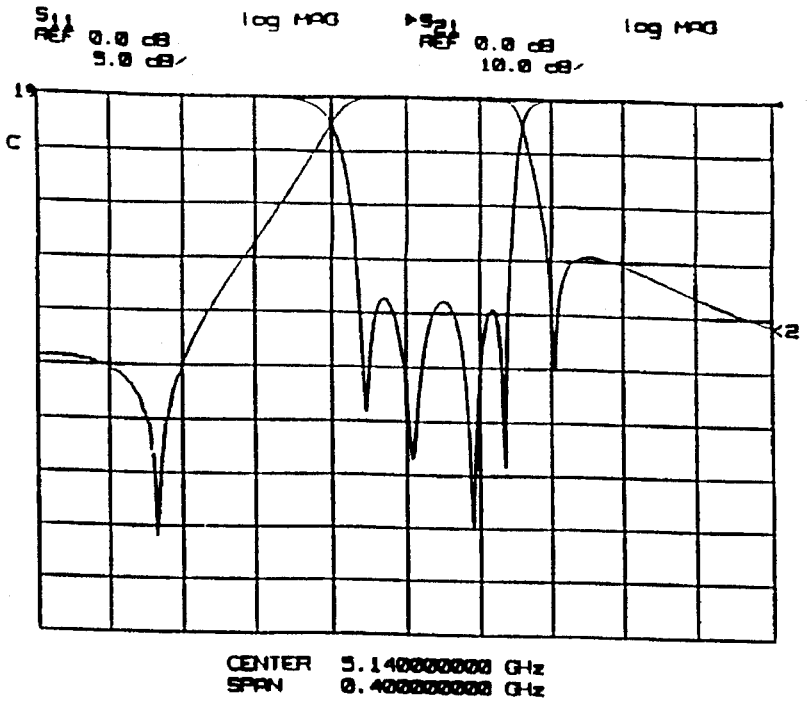
FIG. 10*a* is a graph showing the RF performance of the dielectric resonator filter disclosed in FIG. 3 before vibrations.
Figure 10B:
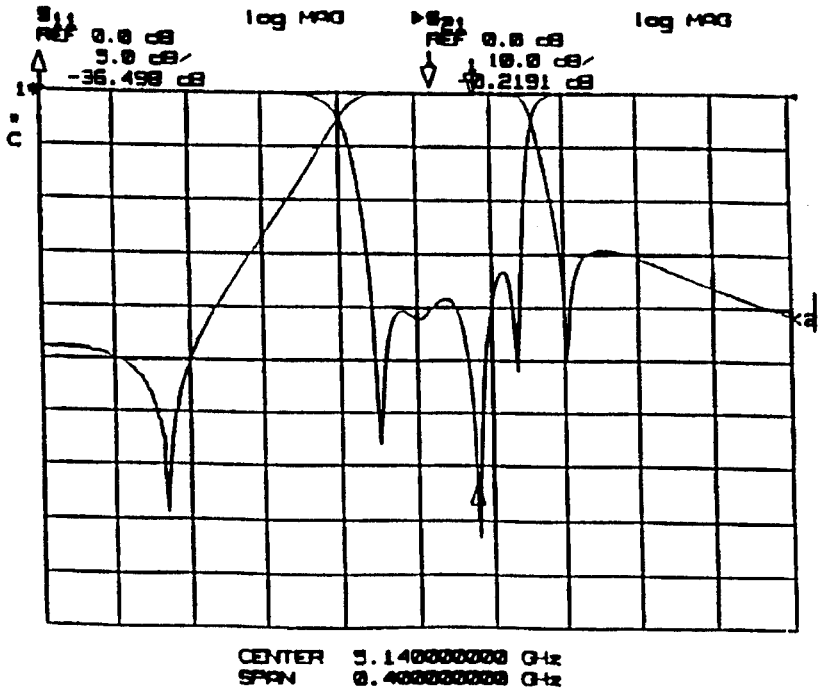
FIG. 10*b* is a graph showing the RF performance of the dielectric resonator filter disclosed in FIG. 3 after vibrations.

When used in space, the filter must be capable of surviving stringent mechanical vibrations. FIG. 10*a* shows the insertion loss and return loss results of a filter constructed in accordance with FIG. 3 before being exposed to typical space-application vibration levels and FIG. 10*b* shows the insertion loss and return loss results after vibration. It can be seen that the results in FIGS. 10*a* and 10*b* are essentially the same and that therefore a filter constructed in accordance with the present invention is capable of withstanding space-application vibration levels.

Figure 11:
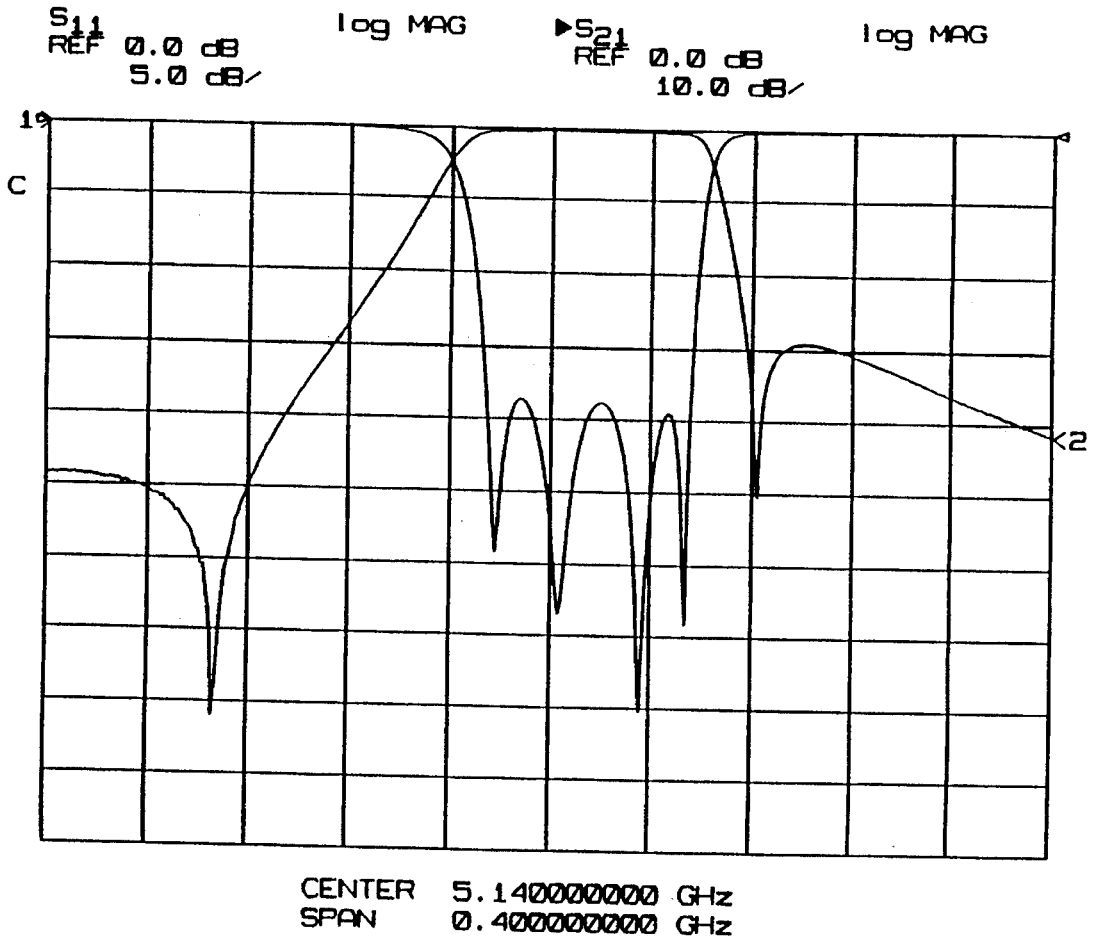
FIG. 11 is a graph showing the RF performance of a dielectric resonator filter shown in FIG. 3 where shorting plates of the filter are made from high temperature superconductive films deposited on a dielectric substrate.

FIG. 11 shows the insertion loss and return loss results of a four-pole dual-mode filter constructed in accordance with FIG. 3 at cryogenic temperatures. The shorting plate 40 used in the filter was the plate 68 described in FIG. 7 with a high temperature superconductor TBCCO thin film layer 70 covering the substrate 72. It can be seen that the filter has a relatively narrow bandwidth (close to 1%) and exhibits a small insertion loss. By comparing the results of FIGS. 9 and 11, it can be seen that the use of high temperature superconductor materials considerably improves the loss performance of the filter.

Figure 12:
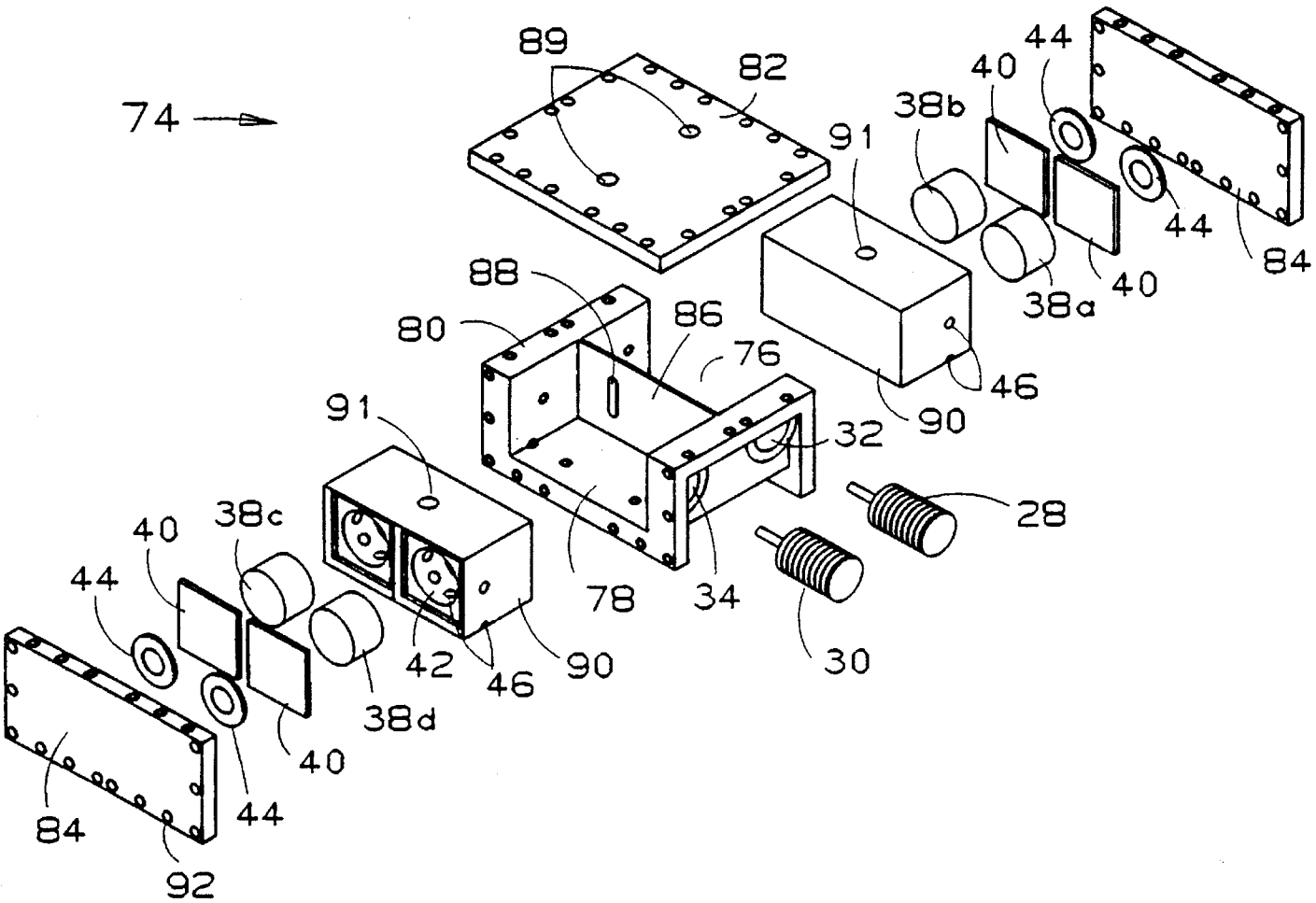
FIG. 12 is an exploded perspective view of a dielectric resonator filter having two cavities with two dielectric resonators in each cavity.

In FIG. 12, there is shown a dielectric resonator filter 74 with two cavities 76, 78 in a housing 80. The same reference numerals are used for those components in FIG. 12 that are the same or similar to components of the filter 12 in FIG. 3. The housing 80 includes a cover plate 82 and two end plates 84. The cavities 76, 78 are separated by an iris 86 containing one aperture 88. As with the filter 12, the aperture can be any suitable shape, but the illustrated aperture 88 is in the form of a slot. The housing 80, including the cover 82 and end plates 84 can be made of any suitable metal, for example, Invar. The cover 82 has two tapped holes 89 for receiving tuning screws (not shown).

Each of the cavities 76, 78 contains a dielectric block 90 that has two hollowed portions 42. Each hollowed portion 42 receives a resonator 38 and shorting plate 40. Springs 44 ensure that good contact is maintained between the shorting plate 40 and the respective adjacent resonators 38*a*, 38*b*, 38*c*, 38*d*. Each block 90 has one hole 91 in a top surface thereof to receive the tuning screw (not shown) that extends through each hole 89 of the cover 82. As with the filter 12, the blocks 90 contain various openings 46 for receiving tuning screws (not shown) and coupling screws (not shown). The tuning screws enter the block 90 at a 90° angle and the coupling screws enter the block 90 at a 45° angle. The filter 74 has an input 28 and an output 30 which are mounted in holes 32, 34 respectively in cavity 78. The input and output are probes. Tiny holes 92 around the periphery of the housing 80 including the cover 82 and end plates 84 are sized to receive screws (not shown) so that the various components can be held together. The tuning and coupling screws, if any, have been omitted from FIG. 12 because the number of screws will vary with the number of modes in which the filter is to be operated and the location of the screws is known to those skilled in the art.

In operation, the dielectric resonators 38*a*, 38*b*, 38*c* and 38*d* can operate in the HE mode to realize an eight-pole dual-mode filter or either the TE mode or the TM mode to realize a four-pole single mode filter. The blocks 90 support the resonators 38*a*, 38*b*, 38*c* and 38*d* in a bottom portion in each of the cavities 76, 78. The hollowed portions 42 are sized and shaped to snugly receive the resonators 38*a*, 38*b*, 38*c* and 38*d* and the shorting plates 40. Coupling between the dielectric resonators within the same cavity could be controlled by adjusting the spacing between the resonators but is preferably controlled by using tuning screws (not shown) inserted through the cover 82 through tapped holes 89, one hole 89 for each cavity. The holes 89 are aligned with the holes 91 in the blocks 90. The coupling between resonators 38*b* and 38*c* of different cavities 76, 78 respectively is achieved through the aperture 88. Energy enters the resonator 38*a* of cavity 76 and 38*b* of cavity 76 by the tuning screw (not shown) in the holes 89, 91 of the cavity 76. Energy is coupled from the resonator 38*b* to the resonator 38*c* through the aperture 88. Energy is coupled from the resonator 38*c* to the resonator 38*d* within the cavity 78 by the tuning screw (not shown) in the holes 89, 91 of the cavity 78. Energy is coupled from the resonator 38*d* out of the cavity 78 through the output probe 30.

Figure 13:
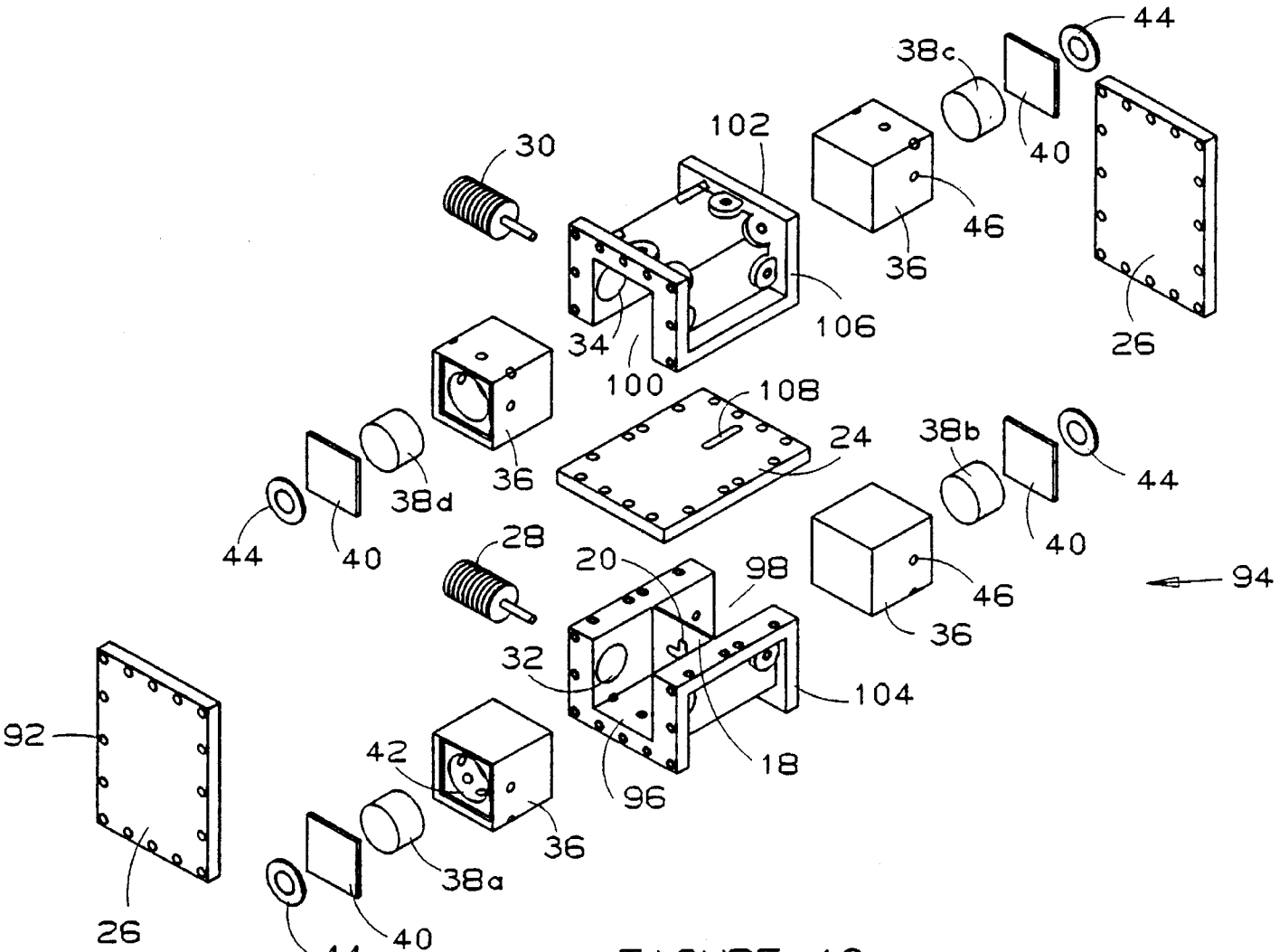
FIG. 13 is an exploded perspective view of a dielectric resonator filter having four cavities with one dielectric resonator in each cavity.

In FIG. 13, there is shown a dielectric resonator filter 94 having four cavities 96, 98, 100, 102 and four dielectric resonators 38*a*, 38*b*, 38*c* and 38*d* respectively. Components of the filter 94 that are the same or similar to those of the filter 12 or the filter 74 have been described using the same reference numerals. In general terms, the filter 94 is very similar to the filter 12 except that the filter 94 has four cavities rather than two cavities. The filter 94 has two housings 104, 106 which are virtually identical to one another except for the location of the holes 32, 34 which receive the input and output probes 28, 30 respectively. Each of the housings 104, 106 share common end plates 26 and share a common cover plate 24. The cavities 96, 98 of the housing 104 are separated by an iris 18 containing an aperture 20. The cavities 100, 102 are also separated by an iris 18 (not shown) containing an aperture (not shown). Each of the cavities has a dielectric block 36 with a hollowed portion 42, a shorting plate 40 and a spring 44. The housings 104, 106, the cover 24 and the end plates 26 all have tiny holes 92 around their peripheries so that they can be affixed to one another using screws (not shown). As with the filter 12, the blocks 36 contain various openings 46 for receiving tuning screws (not shown) and coupling screws (not shown). The tuning and coupling screws have been omitted from the drawings for the same reasons as given for FIG. 12.

In operation, the dielectric resonators 38*a*, 38*b*, 38*c*, 38*d* can operate either in a HE mode, TE mode or TM mode to achieve either an eight-pole filter or a four-pole filter as previously discussed with respect to filter 74. The embodiment shown in FIG. 13 is set up for dual-mode operation because of the presence of openings 46 at a 45° angle to receive coupling screws. Energy is coupled into the cavity 96 through input probe 28 to the dielectric resonator 38*a*. Energy is coupled between the resonators 38*a* and 38*b* through aperture 20 of the iris 18 located in the housing 104. Energy is coupled between the resonator 38*b* and the resonator 38*c* through a slot 108 in the cover 24. Energy is coupled from the resonator 38*c* to the resonator 38*d* through the aperture 20 located in the housing 106. Energy is coupled from the resonator 38*d* to the output through output probe 30. The apertures 20 are shown as having a cruciform shape but can have any suitable shape and can be arranged to provide any filter realization such as Chebyshev, elliptic or linear phase functions.

Figure 14:
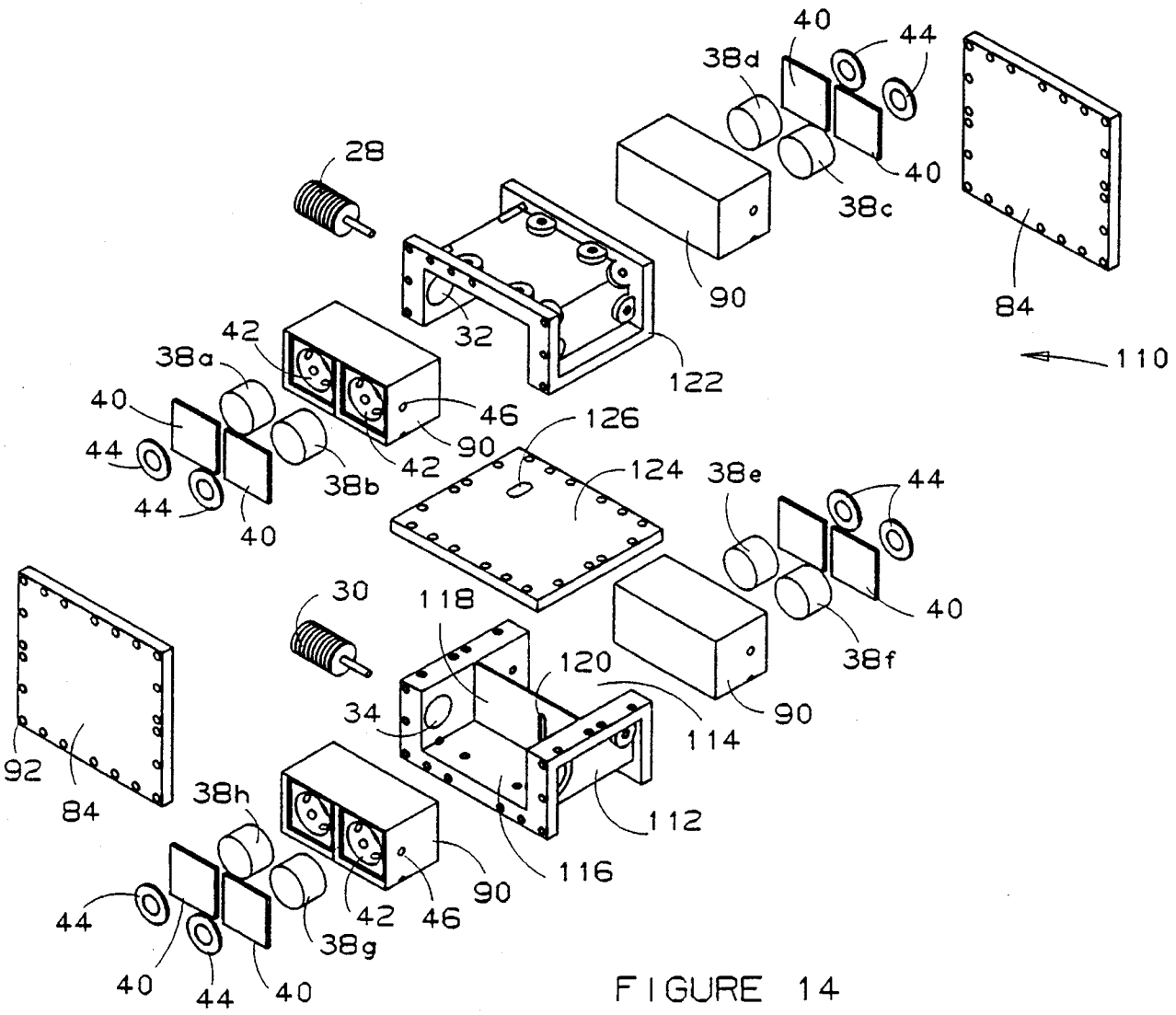
FIG. 14 is an exploded perspective view of a further embodiment of a dielectric resonator filter having four cavities where there are two dielectric resonators located in each cavity.

FIG. 14 shows an eight-pole single mode dielectric resonator filter 110. The filter 110 has eight dielectric resonators 38*a*, 38*b*, 38*c*, 38*d*, 38*e*, 38*f*, 38*g*, 38*h* and has the general configuration of two filters 74 as shown in FIG. 12 combined together. The same reference numerals have been used for the filter 110 for those components that are the same or similar to the components used in the filter 74. A housing 112 has two cavities 114, 116 that are separated by an iris 118 containing an aperture 120. The housings 112, 122 share a cover plate 124 that contains a slot 126 and share common end plates 84. The housing 122 has an iris 118 with an aperture 120 (not shown in FIG. 14), the aperture being located between the resonators 38*b* and 38*c*. The tuning and coupling screws have been omitted from the drawing for the same reasons given for FIG. 12. The filter 110 can be operated in a single mode or dual mode. When the filter 110 is used as a single mode filter, the openings 46 that extend into the blocks 90 at a 45° angle would be omitted because coupling screws are not required. In operation, energy is coupled into the resonator 38*a* through the input probe 28. Energy is coupled from the resonator 38*a* to the resonator 38*b* by controlling the spacing between the resonators. Energy is coupled from the resonator 38*b* to the resonator 38*c* through the aperture 120 (not shown) in the housing 122. Energy is coupled between the resonator 38*c* and the resonator 38*d* and is controlled by controlling the spacing between these resonators. Energy is coupled from the resonator 38*d* through the slot 126 to the resonator 38*e*. Energy is coupled from the resonator 38*e* to the resonator 38*f* through the spacing between these two resonators. Energy is coupled from the resonator 38*f* through the aperture 120 of the housing 112 through the resonator 38*g*. Energy is coupled from the resonator 38*g* to the resonator 38*h* by controlling the spacing between these resonators. Energy is coupled from the resonator 38*h* out of the filter through the output probe 30. The coupling between adjacent resonators within the same block 90 can, alternatively, be controlled using tuning screws (not shown).

Figure 15:
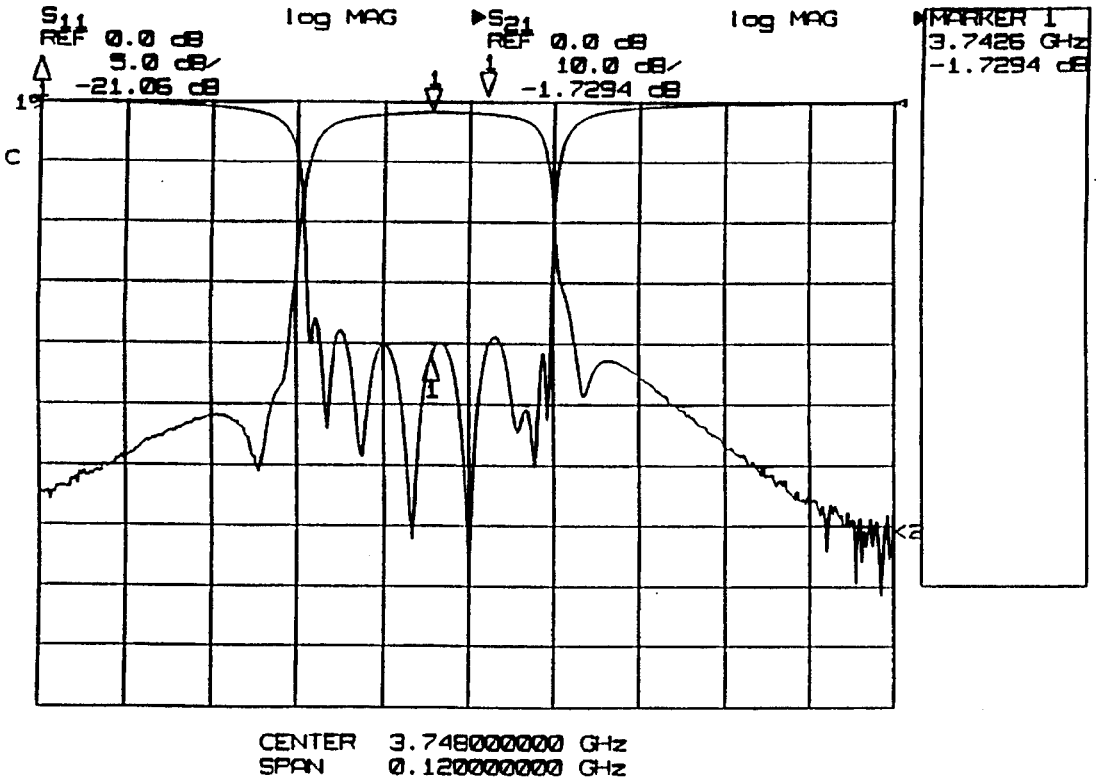
FIG. 15 is a graph showing the RF performance of an eight-pole filter having a shorting plate as described in FIG. 6.
Figure 16:
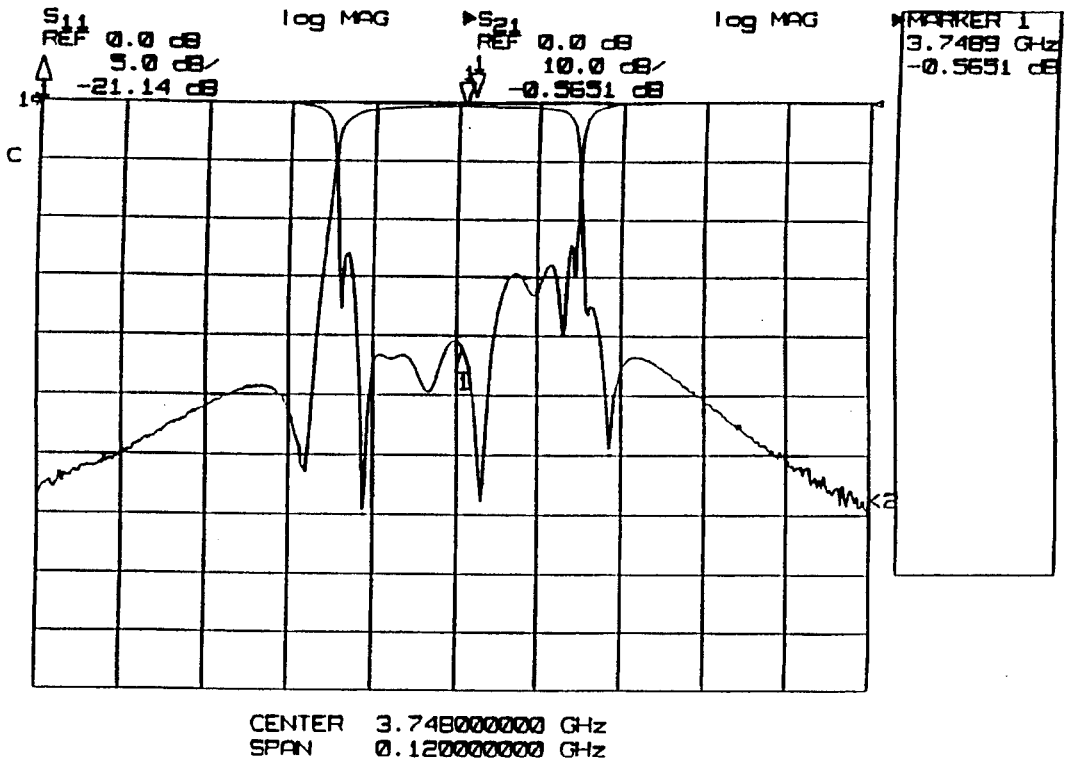
FIG. 16 is a graph showing the RF performance of an eight-pole filter operating at cryogenic temperatures having a shorting plate as described in FIG. 7.

FIG. 15 shows the measured performance of an eight-pole filter constructed in accordance with the filter 94 shown in FIG. 13. The filter was constructed using the shorting plate shown in FIG. 6. In FIG. 16, the same filter 94 was used except that the shorting plate shown in FIG. 7 was substituted for the shorting plate shown in FIG. 6 and the filter was operated at cryogenic temperatures. By comparing FIGS. 15 and 16, it can be seen that the insertion loss performance of the filter 94 is considerably improved when the filter is operated at cryogenic temperatures using high temperature superconductor materials for the shorting plates 40. The results shown in the graphs of this application are examples only.

While various configurations of filters are shown in the drawings, it will be readily apparent to those skilled in the art that other configurations could be utilized as well within the scope of the attached claims. For example, a filter could have three dielectric resonators and could be a three-pole or a six-pole filter, or a filter could have five, six or seven resonators or more than eight resonators. The filter can be operated in either a single mode or a dual mode. A filter can be operated at ambient temperatures or, by using shorting plates having a thin film of high temperature superconductor film thereon, the filter can be operated at cryogenic temperatures.

In accordance with the above-described structure, it becomes possible to use a filter by tuning it at cryogenic temperatures (approximating those in which the filter will ultimately be deployed), and then storing the filter at room temperature prior to deployment. This is most convenient for satellite applications since the filters can be tuned by the manufacturer well before the filters are to become operational. The thermal expansion of component parts is uniform, and the filter does not lose its initial tuning as it warms to ambient temperatures. The present invention also encompasses the above-described method of using a filter by: 1) tuning at cryogenic temperature; 2) storing at room temperature; and 3) deploying at cryogenic temperature (in space).

Various changes in the structure of the filter or method of its use, within the scope of the attached claims, will be readily apparent to those skilled in the art. For example, the cavities could have a cylindrical shape with the blocks remaining square or rectangular or the blocks could have a cylindrical shape with square, rectangular or cylindrical cavities. Various shapes will be suitable for the blocks.

Having now fully set forth a detailed example and certain modifications incorporating the concept underlying the present invention, various other modifications will obviously occur to those skilled in the art upon becoming familiar with the underlying concept. For instance, although the present invention is especially suited for cryogenic applications, it should be understood that the filter of the present invention is equally well-suited for conventional use at room temperature. A smaller size and better loss performance will still be attained. It is to be understood, therefore, that within the scope of the appended claims, the invention may be practiced otherwise than as specifically set forth herein.

What we claim as our invention is:

1. A method of using a microwave cavity filter, comprising the steps of:

(a) tuning said filter to achieve a first resonant frequency at a cryogenic temperature;

(b) allowing said filter to warm to room temperature; and (c) deploying and operating said filter in space at a cryogenic temperature;

whereby said filter continues to operate at said first resonant frequency despite the intervening temperature variation and ensuring compatible thermal expansion of component parts.

2. A microwave filter, comprising:

(a) a filter housing defining a resonant cavity therein for resonating in at least one mode at a resonant frequency associated with said cavity;

(b) a support block disposed in said cavity, said block having a recess in an end thereof, said support block being comprised of a dielecitric material;

(c) said support block and said housing being comprised of respective materials which have substantially similar coefficients of thermal expansion;

(d) a resonator element seated in the recess of said dielectric block;

(e) an input operatively connected to said cavity for coupling electromagnetic energy therein;

(f) an output operatively connected from said cavity for coupling electromagnetic energy therefrom.

3. The microwave filter according to claim 1, wherein said filter housing, support block, and said resonator element are comprised of respective materials having substantially equal coefficients of thermal expansion.

4. The microwave filter according to claim 2, wherein said support block and said housing are comprised of respective materials which have substantially equal coefficients of thermal expansion.

5. The microwave filter according to claim 4, wherein said support block and said filter housing have different coefficients of thermal expansion from said resonator.

6. The microwave filter according to claim 2, further comprising a shorting plate disposed over said recess and maintained in electrical contact against an exposed surface of the resonator element.

7. The microwave filter according to claim 6, wherein said shorting plate functions as an image plate.

8. The microwave filter according to claim 6, wherein said shorting plate comprises a layer of superconductive material.

9. The microwave filter according to claim 6, further comprising a spring element which is located adjacent said shorting plate to bias said shorting plate against the resonator element.

10. The microwave filter according to claim 9 wherein said spring element further comprises a belleville spring washer.

11. The microwave filter according to claim 10, wherein said belleville spring washer is comprised of stainless steel plated with a high-conductivity material.

12. The microwave filter according to claim 2, further comprising at least one tuning screw mounted in said filter housing for tuning said filter.

13. The microwave filter according to claim 2, wherein said microwave filter operates in dual orthogonal modes, each cavity having two tuning screws, one tuning screw for each mode.

14. The microwave filter according to claim 13, further comprising a mode coupling screw in each cavity for coupling said dual orthogonal modes.

15. The microwave filter according to claim 2, wherein said input to said resonant cavity is a microwave probe.

16. The microwave filter according to claim 2, wherein said output from said cavity is a microwave probe.

17. The microwave filter according to claim 2, wherein an interior of the resonant cavity of said filter housing includes a plating of a high-conductivity material.

18. The microwave filter according to claim 17, wherein the high-conductivity material is silver.

19. The microwave filter according to claim 17, wherein an interior of the resonant cavity of said filter housing includes a coating of superconductive material.

20. A dual-mode image-resonant microwave filter, comprising:

(a) a filter housing defining two resonant cavities therein for resonating in two orthogonal modes at a resonant frequency associated with corresponding ones of said two cavities;

(b) a pair of dielectric blocks, each block disposed in a corresponding one of said resonant cavities, each block having a perimeter of a size to fit within said respective cavity, and each block having a depression in a respective end thereof for seating a corresponding resonator element therein;

(c) a pair of resonator elements each seated in a corresponding one of said dielectric blocks;

(d) a pair of image plates, each plate disposed over a respective one of said resonator elements within the corresponding dielectric block and maintaining electrical contact against the respective resonator element, and each of said image plates defining a major portion of one wall of a resonant cavity; and (e) said filter having an input and output operatively connected thereto;

whereby said respective image plates reduce the self-resonant frequencies of the corresponding resonator elements.

21. A dual-mode image-resonant microwave filter according to claim 20, further comprising a pair of spring elements located adjacent to said pair of image plates, each spring element biasing a respective one of said image plates against the corresponding resonator element.

22. A microwave filter, comprising:

(a) a filter housing defining at least two electromagnetically coupled resonant cavities therein;

(b) a pair of support blocks each disposed in a corresponding one of said resonant cavities, each block having a respective recess in an end thereof for seating a corresponding resonator element therein, said support blocks being comprised of a dielectric material;

(c) a pair of resonator elements each seated in a respective one of said support blocks, said respective support block and said housing being comprised of respective materials which have substantially similar coefficients of thermal expansion;

(d) an input operatively connected to a respective one of said cavities for coupling electromagnetic energy therein;

(e) an output operatively connected from a respective one of said cavities for coupling electromagnetic energy therefrom.

23. The microwave filter according to claim 22, wherein said support blocks and resonator elements are comprised of respective dielectric materials which have substantially equal coefficients of thermal expansion.

24. The microwave filter according to claim 22, further comprising a pair of shorting plates each respectively disposed over a corresponding resonator element in a corresponding recess of said support blocks and maintained in electrical contact against an exposed surface of the resonator elements therein.

25. The microwave filter according to claim 24, wherein said shorting plates function as image plates.

26. The microwave filter according to claim 22, further comprising a pair of spring elements located adjacent to each shorting plate, each of said pair of spring elements respectively disposed for biasing a corresponding shorting plate against one of said corresponding resonator elements.

27. The microwave filter according to claim 26, wherein each of said pair of spring elements further comprise belleville spring washers.

28. The microwave filter according to claim 22, further comprising at least one tuning screw extending into each one of said cavities for tuning said filter.

29. The microwave filter according to claim 22, wherein each of said resonant cavities operates in dual orthogonal modes, with an iris located to couple said modes between the cavities.

30. The microwave filter according to claim 29, further comprising a pair of mode coupling screws mounted in said filter housing and each penetrating a respective one of said cavities for coupling said dual orthogonal modes.

31. The microwave filter as claimed in claim 30 wherein there are four cavities, with one block and one dielectric resonator and corresponding shorting plate mounted in each block, there being two irises, one iris being located between a first and second cavity and another iris being located between a third and fourth cavity, each iris having two sides, each iris having an aperture shaped to permit coupling between the dielectric resonators located on either side of said iris, the filter being operated in a mode selected from the group of an HE mode to realize an eight-pole dual mode filter, a TE mode to realize a four-pole single mode filter and a TM mode to realize a four-pole single mode filter.

32. The microwave filter as claimed in claim 30 wherein there are two blocks and two dielectric resonators mounted in one block plus three dielectric resonators mounted in another block, the coupling between resonators in adjacent blocks being controlled by an aperture located in an iris with means to control the coupling between resonators located in the same block.

33. A microwave filter, comprising:

(a) a filter housing defining a resonant cavity therein for resonating in at least one mode at a frequency associated with said cavity;

(b) a resonator element supported within said resonant cavity;

(c) a shorting plate maintained in contact against said resonator element;

(d) a dielectric block disposed in said resonant cavity, said block having a perimeter of a size which allows for a snug fit within said cavity, and said block having a two-tiered recess in an end thereof, one tier of said recess for seating said resonator element, and another tier of said recess for seating said shorting plate over said resonator element;

(e) a spring element located adjacent to said shorting plate for biasing said shorting plate against the resonator element; and (f) said filter having an input and output operatively connected thereto.

34. The microwave filter according to claim 33, wherein said shorting plate further comprises a layer of superconductive material disposed on a dielectric substrate.

35. The microwave filter according to claim 34, wherein said dielectric substrate is selected from the group of lanthium aluminate and sapphire.

36. The microwave filter according to claim 34, wherein said layer of superconductive material further comprises a thin-film layer of ceramic high-temperature superconducting material.

37. The microwave filter according to claim 36, wherein said ceramic material is selected from the group of yttrium barium copper oxide and thallium barium copper calcium oxide.

38. The microwave filter as claimed in claim 33 wherein there is a second resonant cavity having another dielectric block disposed in said second cavity, each block containing two dielectric resonators and corresponding shorting plates, the dielectric resonators being operated in a mode selected from the group of a HE mode to realize an eight-pole dual mode filter, a TE mode to realize a four-pole single mode filter and a TM mode to realize a four-pole single mode filter, there being sufficient tuning screws and coupling screws as required, said tuning and coupling screws penetrating the cavity in which they are located, with means to control coupling between the resonators located within the same block and an iris containing an aperture located between said cavities to control coupling between the resonators in different blocks, said blocks containing channels to receive said tuning and coupling screws.

39. A microwave filter, comprising:

(a) a filter housing defining a resonant cavity therein for resonating in at least one mode;

(b) a dielectric block disposed in said cavity, said block having a recess in an end thereof;

(c) a resonator element seated in the recess of said dielectric block, said dielectric block and resonator element being comprised of different dielectric materials having approximately equal coefficients of thermal expansion;

(d) a shorting plate over said recess and maintained in electrical contact against an exposed surface of the resonator element;

(e) said filter having an input and output operatively connected thereto:

wherein the microwave filter is tuned while at cryogenic temperature to achieve a first resonant frequency, and continues to operate at said first resonant frequency despite being warmed to room temperature and recooled to cryogenic temperature.

* * * * *